United States Patent [19]

Mendelovich

[11] 4,228,925

[45] Oct. 21, 1980

[54] TOOTHPASTE HOLDER AND DISPENSER

[76] Inventor: Isaac Mendelovich, 1936 Kentwood St., Philadelphia, Pa. 19116

[21] Appl. No.: 835,749

[22] Filed: Sep. 22, 1977

[51] Int. Cl.[2] ..... F65D 35/20; F65D 35/36

[52] U.S. Cl. ..... 222/103; 222/105; 401/125

[58] Field of Search ..... 222/103, 105, 93, 106; 141/360, 373; 401/125

[56] References Cited

U.S. PATENT DOCUMENTS

| | | | |
|---|---|---|---|
| 867,017 | 9/1907 | De Mond | 141/360 |
| 2,542,678 | 2/1951 | Keefer | 222/150 X |
| 2,556,826 | 6/1957 | Stone | 141/373 X |
| 2,634,026 | 4/1953 | Yuan | 141/360 X |
| 2,775,989 | 1/1957 | Jensen | 222/105 X |
| 2,856,971 | 10/1958 | Francolino | 222/103 X |
| 3,020,941 | 2/1962 | Corley | 222/105 X |

FOREIGN PATENT DOCUMENTS

| | | | |
|---|---|---|---|
| 552151 | 1/1958 | Canada | 222/103 |
| 1921427 | 4/1969 | Fed. Rep. of Germany | 222/105 |
| 497157 | 8/1954 | Italy | 222/103 |

*Primary Examiner*—Robert J. Spar
*Assistant Examiner*—Frederick R. Handren
*Attorney, Agent, or Firm*—Benjamin J. Barish

[57] ABSTRACT

A toothpaste holder and dispenser is described comprising a housing including a compartment for receiving a collapsible tube of toothpaste, the compartment having a wall formed with an opening through which the toothpaste is dispensed. The housing includes a closure member normally closing the dispensing opening but engageable by a toothbrush for opening same to thereby permit the collapsible tube to dispense toothpaste onto the toothbrush. The housing further includes a second compartment for receiving the toothbrush, the latter having detent means for holding the toothbrush within its compartment.

4 Claims, 4 Drawing Figures

TOOTHPASTE HOLDER AND DISPENSER

BACKGROUND OF THE INVENTION

The present invention relates to a toothpaste holder and dispenser, and particularly to one capable of retaining a large supply of toothpaste and of dispensing same onto a toothbrush as and when needed.

Many types of toothpaste holders and dispensers have been devised. Most of the known types include arrangements wherein the toothpaste is retained within a compartment formed in the handle of the toothbrush. Such arrangements, however, have very limited capacity as to the quantity of toothpaste they are capable of holding and dispensing.

An object of the present invention is to provide a toothpaste holder and dispenser capable of holding a large quantity of toothpaste. A further object of the invention is to provide a toothpaste holder and dispenser also capable of holding the toothbrush.

SUMMARY OF THE INVENTION

According to the invention, there is provided a toothpaste holder and dispenser, comprising: a housing including a first compartment having a greater length than width for receiving a collapsible tube of toothpaste; a pressure member in the first compartment for collapsing the tube to dispense toothpaste therefrom; and a second compartment of substantially the same length as the first compartment for receiving a toothbrush therein. The second compartment is closed at one end and is open at the opposite end for receiving the toothbrush through the open end. The housing further includes a partition wall common to and separating both compartments and formed with a dispensing opening therethrough adjacent to the closed end of the second compartment for dispensing the toothpaste from the collapsible tube in the first compartment to the toothbrush in the second compartment.

A closure member is provided in the second compartment adjacent to its closed ends and a spring urges the closure member away from the closed end to underlie the dispensing opening in the partition wall. The second compartment is of sufficient length to retain the toothbrush therein and to permit the toothbrush to be manually moved towards the closed end of the second compartment to engage the closure member and to move same towards the closed end of the second compartment, thereby to uncover the dispensing opening and to permit the dispensing of toothpaste therethrough onto the toothbrush.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF THE PREFERRED EMBODIMENT

Figure 2:
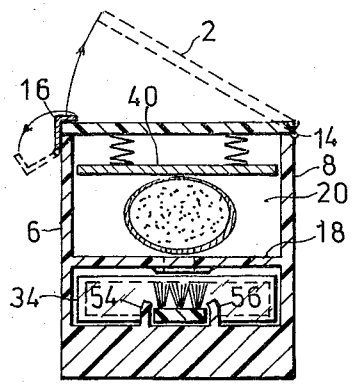
FIG. 2 is a transverse sectional view along lines II—II of FIG. 1.

The toothpaste holder and dispenser illustrated in the drawings comprises a housing including a top wall 2, a bottom wall 4, a pair of side walls 6 and 8, and a pair of end walls 10 and 12. All the foregoing walls, except the top wall 2, may be formed as a single-piece unit of injection-moulded plastic. The top wall 2 is in the form of a lid pivotable to an open position (as shown in broken lines in FIG. 2) by means of a hinge 14 extending along side wall 8 and retained in its closed position by means of a clip 16 carried by the opposite side wall 6.

Figure 1:
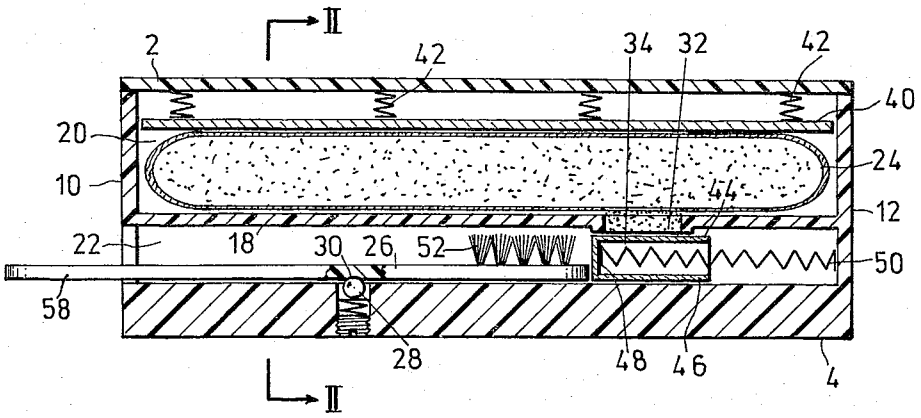
FIG. 1 is a longitudinal sectional view of one form of toothpaste holder and dispenser constructed in accordance with the present invention.
Figure 3:
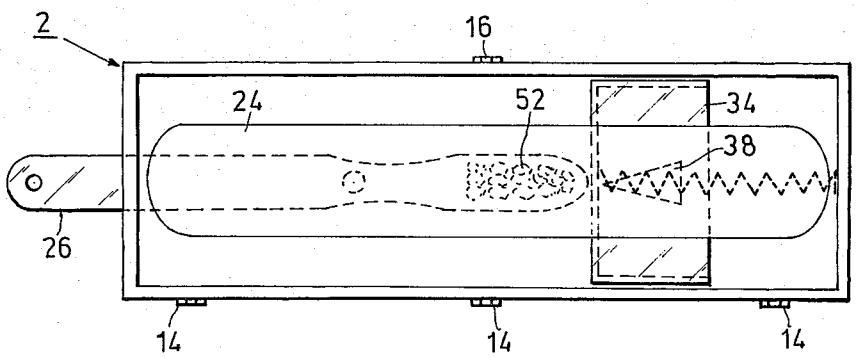
FIG. 3 is a top plan view of the holder and dispenser of FIGS. 1 and 2 with the upper lid of the housing removed to show internal structure.

The housing is further formed with a partition wall 18 dividing its interior into a pair of compartments 20 and 22. The upper compartment 20 is adapted to receive a collapsible tube of toothpaste 24, and the lower compartment 22 is adapted to receive a toothbrush 26. The bottom wall 4 of the housing includes detent means, in the form of a spring-urged ball 28, receivable in a recess 30 formed in the lower face of the toothbrush handle for retaining the toothbrush in a first position, namely that illustrated in FIG. 1, within its compartment 22.

Partition wall 18 is thus common to both of the compartments 20 and 22. It is formed with an opening 32 through which the toothpaste from the collapsible tube 24 within compartment 20 may be dispensed onto the bristles of the toothbrush 26 within compartment 22. Normally, opening 32 is closed by a spring-urged closure member 34, but may be opened by moving the toothbrush 26 against the closure member 34 to cause it to uncover the dispensing opening 32.

Figure 4:
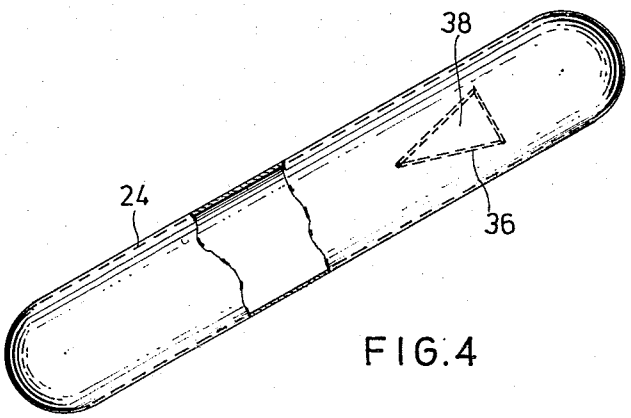
FIG. 4 illustrates a collapsible tube of toothpaste used in the holder and dispenser of FIGS. 1–3.

Tube 24 is adapted to contain a large quantity of toothpaste. It may be of metal or plastic capable of being collapsed by pressure. It is formed with weakened lines 36 (FIG. 4) which may be severed to define an opening 38 through which the toothpaste may be dispensed. Opening 38 is preferably of the triangular shape illustrated in FIG. 4, and when the tube 24 is disposed within compartment 20 of the dispenser, it is aligned with dispensing opening 32 in the partition wall 18, with the narrow end of the opening facing the toothbrush 26.

The dispenser further includes a spring-urged pressure member 40 which bears against tube 24 and tends to collapse it. Member 40 is in the form of a pressure plate attached by means of springs 42 to the inner face of the pivotable lid 2 of the housing. Accordingly, when the lid is pivoted to its closed position, and retained in such position by means of the clip 16, pressure plate 40 bears against the upper face of tube 24 and tends to collapse the tube and thereby to force toothpaste through its opening 38 and through opening 32 in partition wall 18.

As indicated above, dispensing opening 32 is normally closed by the spring-urged closure member 34, thereby blocking the dispensing of toothpaste. Closure member 34 is of U-shaped cross-section, including a pair of parallel legs 44, 46, bridged by an intermediate bridge section 48. The closure member is normally urged to close dispensing opening 32 by means of a spring 50 having one end engageable with the inner face of bridge section 38, and the opposite end engageable with the inner face of end wall 12. The closure member may be moved against spring 50 to uncover the dispensing opening 32 when toothbrush 26 is thrust inwardly in its compartment 22, with the tip of the toothbrush bearing against the outer face of the bridge section 48 of the closure member. It will thus be seen that when the closure member is moved to its open position by means of the toothbrush 26, the bristles 52 of the toothbrush will underlie the dispensing opening 32, and will thereby receive a charge of toothpaste.

The movement of the toothbrush 26 within its compartment 22 is guided by a pair of parallel guiding ribs 54, 56, moulded integrally with the bottom wall of the dispenser housing. The movement of the closure member 34 is guided by its U-shaped construction since its upper leg 44 is slidable along the surface of partition wall 18, and its lower leg 46 is slidable along the inner face of the housing bottom wall 4.

The dispenser illustrated is capable of holding a large quantity of toothpaste within the collapsible tube 24, which tube may be replaced when empty by merely pivoting opening the housing lid 2, removing the empty tube, and inserting a fresh tube of toothpaste. Before inserting the fresh tube, its weakened lines 36 would be severed so as to provide the opening 38, which opening would be aligned with the dispensing opening 32 in the partition wall 18.

Preferably, the portion 58 of the handle of the toothbrush 26 projecting from the housing when the toothbrush is retained within the housing by the ball-and-detent elements 28, 30, is differently coloured from the remainder of the handle to indicate this home position of the toothbrush. Further the toothpaste tube 24 could be provided with means, such as a projection, for registering the opening 38 with the dispensing opening 52 in partition wall 18. Also, the dispenser housing is preferably made of transparent plastic material, or is provided with a transparent window, to enable the user to view the toothpaste tube 24 so that he can readily see when it is necessary to replace it with a fresh tube of toothpaste. The open end of compartment 22 receiving the toothbrush 26 permits the circulation of air within the compartment thereby facilitating the drying of the toothbrush bristles 52. To enhance the circulation of air, the walls defining this compartment (namely side walls 6, 8, bottom wall 4, and partition wall 18) may all be perforated.

The toothpaste holder and dispenser may be supported, or mounted to a wall in any suitable manner, such as by the use of fasteners or magnets (not shown).

It will thus be seen that the holder and dispenser illustrated in the drawings is not only capable of holding a large quantity of toothpaste, which may be readily replaced by fresh toothpaste tubes when needed, but also provides a compact and conveniently-usable arrangement for holding the toothbrush and for applying toothpaste to it when the user desires to brush his teeth.

While the invention has been described with respect to one preferred embodiment, it will be appreciated that many variations, modifications, and other applications of the invention may be made.

What is claimed is:

1. A toothpaste holder and dispenser, comprising: a housing including a first compartment having a greater length than width for receiving a collapsible tube of toothpaste; a pressure member in said first compartment for collapsing the tube to dispense toothpaste therefrom; a second compartment of substantially the same length as said first compartment for receiving a toothbrush therein; said second compartment being closed at one end and open at the opposite end for receiving the toothbrush through the open end; a partition wall common to and separating both said compartments and formed with a dispensing opening therethrough adjacent to the closed end of the second compartment for dispensing the toothpaste from the collapsible tube in the first compartment to the toothbrush in the second compartment; a closure member in said second compartment adjacent to its closed end; and a spring urging said closure member away from said closed end to underlie said dispensing opening in the partition wall; said second compartment being of sufficient length to retain the toothbrush in a first position therein and to permit the toothbrush to be manually moved towards the closed end of the second compartment to engage the closure member and to move same towards the closed end of the second compartment, thereby to uncover said dispensing opening and to permit the dispensing of toothpaste therethrough onto the toothbrush, said second compartment further including detent means for retaining the toothbrush in said first position therein, said detent means comprising a spring-urged ball disposed in the bottom wall of the housing and receivable in a recess formed in the toothbrush handle, and guide means for guiding the movement of the toothbrush from said first position to engage said closure member and to move same towards the closed end of the second compartment.

2. A toothpaste holder and dispenser according to claim 1, wherein said closure member is of U-shape cross-section, having a pair of parallel legs bridged by a bridge section, one leg slidably engaging said common wall to open and close the dispensing opening while guided for movement by the other leg slidably engaging the bottom wall of the housing.

3. A toothpaste holder and dispenser according to claim 1, wherein said top wall of the housing is a lid pivotable with respect to said pressure member to open and closed positions to provide access to the interior of said collapsible tube compartment.

4. A toothpaste holder and dispenser according to claim 1, wherein said pressure member is a spring-urged pressure plate carried by the top wall of the housing and spring-urged to collapse the toothpaste tube in the second compartment.

* * * * *